United States Patent [19]

Forgione

[11] 4,372,081

[45] Feb. 8, 1983

[54] HEAT RELEASABLE WINDOW GUARD

[76] Inventor: Joseph Forgione, 6145 Highway 51 North, Millington, Tenn. 38053

[21] Appl. No.: 264,686

[22] Filed: May 18, 1981

[51] Int. Cl.[3] ..... E05F 15/20

[52] U.S. Cl. ..... 49/8; 49/56

[58] Field of Search ..... 49/8, 7, 56, 57, 141

[56] References Cited

U.S. PATENT DOCUMENTS

| | | | |
|---|---|---|---|
| 777,300 | 12/1904 | Moody | 49/8 |
| 3,832,805 | 9/1974 | Stevens | 49/56 X |
| 3,953,939 | 5/1976 | Klein | 49/56 |
| 4,019,281 | 4/1977 | Weiler | 49/56 |
| 4,059,413 | 11/1977 | Forgione | 49/56 |

*Primary Examiner*—Philip C. Kannan

*Attorney, Agent, or Firm*—Walker & McKenzie

[57] ABSTRACT

A window guard intended to safeguard a window of a dwelling and is constructed so that a portion thereof may be slidably moved away from its normal SAFE-GUARD or UP position to provide an escape route for the inhabitants of the dwelling in the event of fire. The window guard is particularly characterized by structure responsive to the heat of a fire in automatically providing such escape route, even though all the while an intruder is denied the convenience of utilizing the window, to which the guard may be attached, for gaining unwarranted entrance into the dwelling.

7 Claims, 12 Drawing Figures

HEAT RELEASABLE WINDOW GUARD

BACKGROUND OF THE INVENTION

1. Field of the Invention

This invention generally relates to the field of movable guard structure for windows and is particularly directed toward guard structure which may be moved independently from the sash structure of the window.

2. Description of the Prior Art

Heretofore, typical movable guard structure for conventional residential windows was of the type which provided security when the windows were open and moved either upwardly with the upper sash or downwardly with the lower sash into the void airspace between inner and outer walls of the structure so as to be totally unobscured when the windows were closed, i.e., coming into play only when the windows were open, thus providing a degree of security only when the windows were open.

Applicant is aware of other movable window guard structure which is mounted on hinges so as to swing about a vertical axis when it is desired that the window be unobscured for various reasons such as cleaning a window or for providing an escape in the event of fire and the like. This latter type of swingable guard includes conventional lock structure for selctively locking the guard in the secure position. A serious problem exists with this type window guard in that the concept is to place the key a given distance away from the window so that an intruder is not able to break the window and reach the key for unlocking the window guard. However, many people have lost their lives in their residence with this type window guard and evidence strongly points to the belief that the frustration and shock precludes clear thinking on the part of the victim which prevents him from either locating the key or going through the mechanical process of unlocking the window guard to establish an escape route.

It should be pointed out that the former mentioned window guard structure which moves up and down with the sash does not enable occupants of the building to escape outwardly through the window in the event of fire and the like, i.e., raising the sash to provide an open window automatically carries the guard structure upwardly across the opening thus obstructing the opening as the sash is lifted.

Applicant is the owner of a U.S. Pat. No. 4,059,413 issued Nov. 22, 1977 for an improvement over existing window security apparatuses and that included guard structure which may be moved independently from the sash structure of the window to provide an escape route for the inhabitants of the dwelling in the event of fire and the like. Indeed, the present invention is an improvement over the just mentioned U.S. Pat. No. 4,059,413.

SUMMARY OF THE INVENTION

The present invention is directed toward overcoming the disadvantages and problems pertaining to previous window guard structure. The concept of the present invention is to provide window security apparatus which is adaptable to the interior side of existing conventional residential window structure or it may be incorporated with the window structure at the time of fabrication thereof for subsequent installation in new construction. The window guard of the present invention is particularly characterized by structure responsive to the heat of a fire in automatically providing an escape route, even though, all the while an intruder is denied the convenience of utilizing the window, to which the guard may be attached, for gaining unwarranted entrance into the dwelling.

DESCRIPTION OF THE PREFERRED EMBODIMENT

Figure 1:
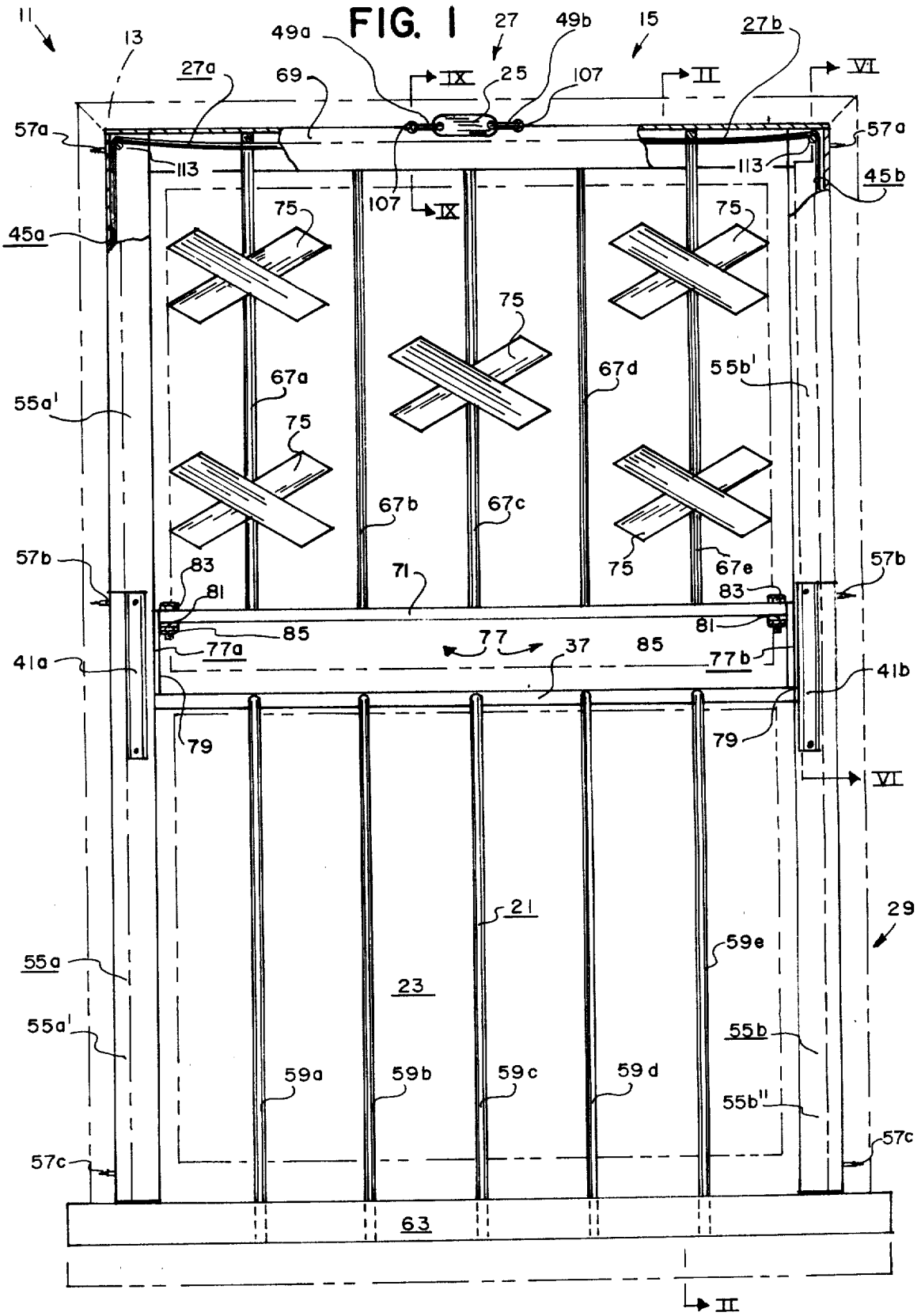
FIG. 1 is an interior elevational view of the window guard of the present invention shown suitably installed on the interior of the usual window structure which is shown in phantom lines with the view being taken while certain movable structure is in a SAFEGUARD or UP position.
Figure 2:
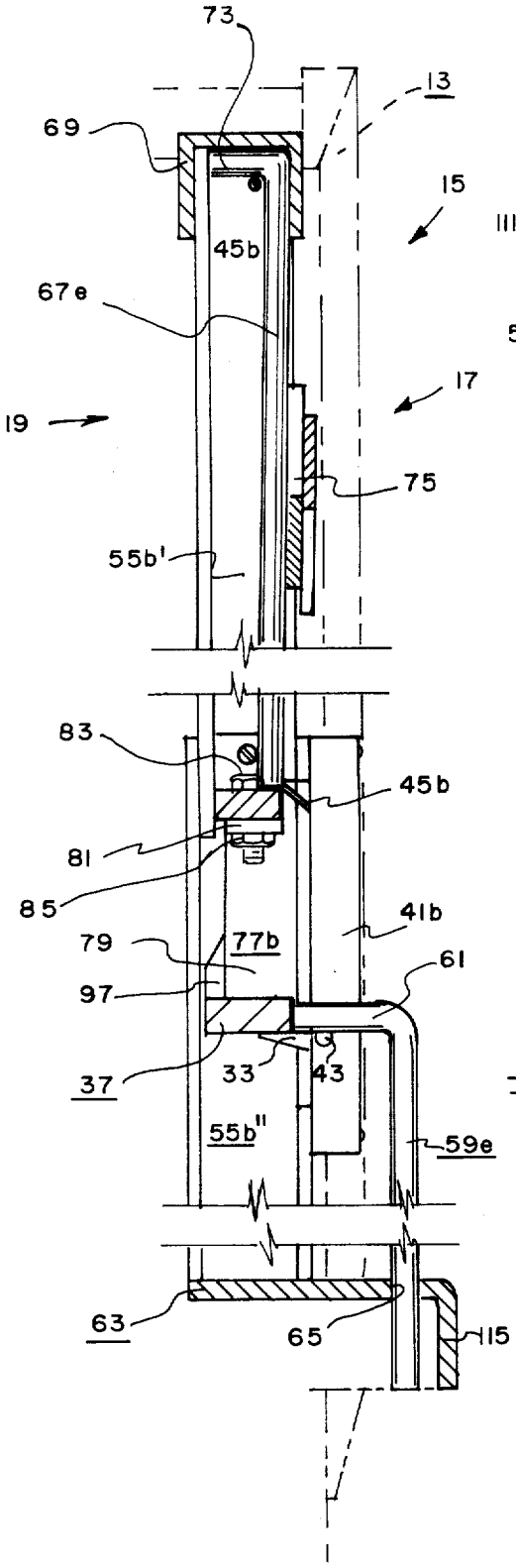
FIG. 2 is an enlarged partial sectional view taken as on the line II—II of FIG. 1.
Figure 3:
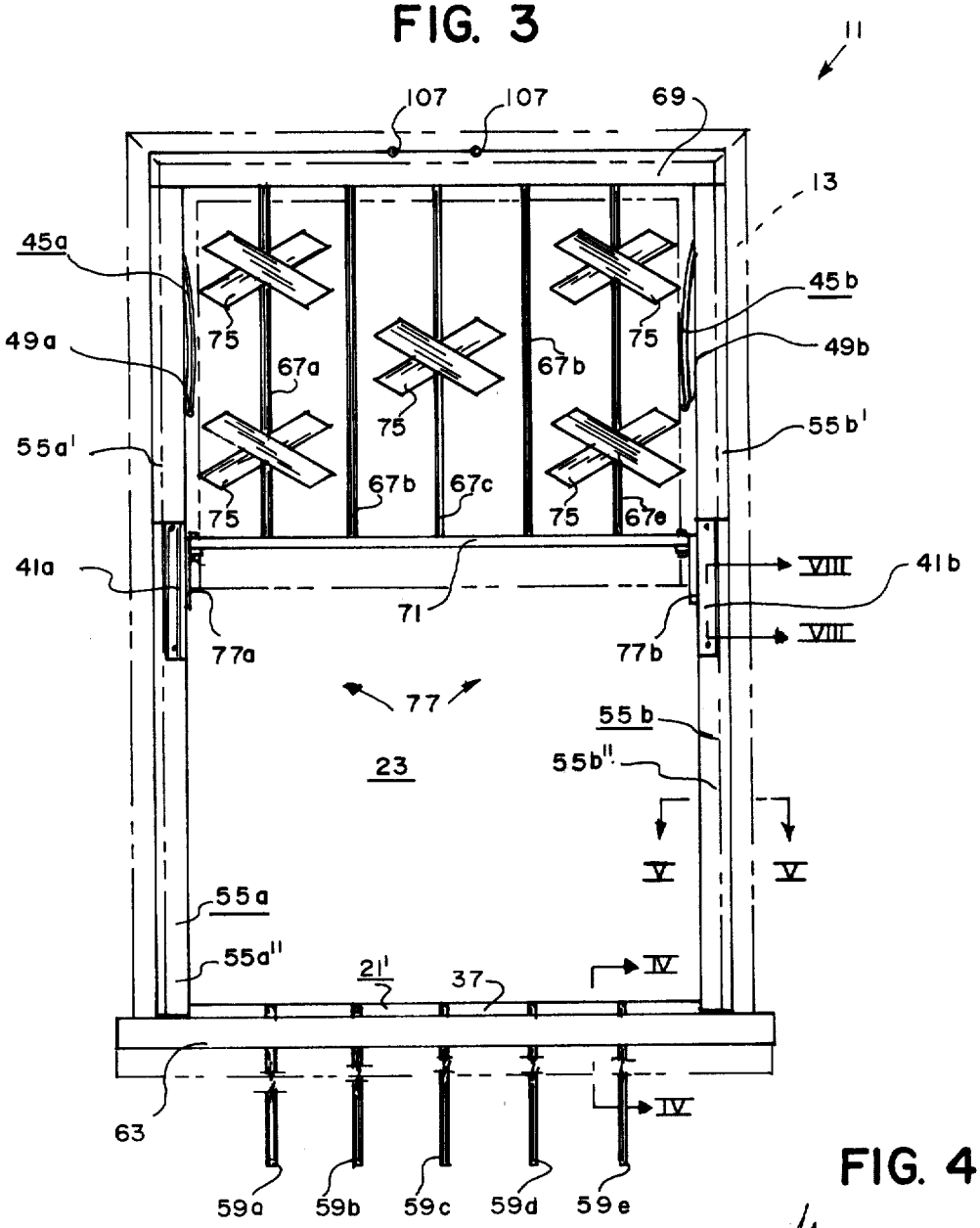
FIG. 3 is a view similar to FIG. 1 with the view being taken with certain movable structure in a DOWN position in which the escape route is provided.

The window guard means 11 of the present invention is intended for providing a degree of security against an intruder gaining entrance into a dwelling (not shown) through the usual window structure characterized by the numeral 13 and shown in phantom lines in FIGS. 1-3 et al of the drawings. The window guard means 11 includes anti-intrusion bar means generally indicated at 15 which is disposed on the interior side, i.e., the interior side is shown in FIG. 2 of the drawings by the numerals 17 while the exterior side will be shown by the numeral 19 of the usual window structure 13, and in proximity thereto. From FIGS. 1 and 2 of the drawings it may readily be seen that at least a portion of the anti-intrusion bar means 11, i.e., a portion characterized therein by the numeral 21, of the anti-intrusion bar means 15 is situated (or configured in a manner to be described) for vertical slidable movement between a normally UP position (in which at least a comparable portion, as at 23, of the usual window structure 13 is adequately guarded therewith) and a DOWN position in which an escape route through the usual window structure 13 is provided the inhabitants of the dwelling in the event of fire. It should be noted that the movable portion 21 is further characterized by a prime suffix when shown in the DOWN position, thus 21' in FIG. 3.

Figure 9:
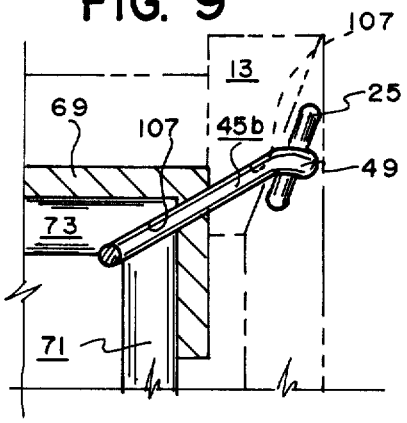
FIG. 9 is an enlarged partial sectional view taken as on the line IX—IX of FIG. 1.

The window guard means also includes fusible link means, as at 25 in FIGS. 1 and 9 of the drawings, for aiding in supporting the movable portion 21 of the anti-intrusion bar means 15 in the UP position. The structure of the fusible link means 25 is well-known to those skilled in the art and are available from various sources, e.g., Elsie Manufacturing Co. located at Pine and Maple Streets, Waterloo, Ind. These fusible link means 25 are Underwriters Laboratory approved and listed as 135°, 160°, 212° F., etc. Fusible link means 25 are also rated in different sizes for different jobs intended, e.g., they are rated in 10 lbs., 30 lbs., 40 lbs., and 50 lbs., etc. Therefore, no attempt will herein be made to disclose the physical characteristics or makeup of fusible link means 25. However, it should be understood that the fusible link means 25 is rendered ineffective when exposed to a predetermined degree of heat. Thus, when used in the manner herein disclosed, the fusible link means 25 enables gravitational means 15 from the UP position thereof to the DOWN position thereof in the event a fire breaks out within the dwelling. Of course, it may readily be seen that the fire escape route alluded to above (or through the comparable portion 23 of the usual window structure 13) is automatically provided while denying the intruder the convenience of utilizing the usual window structure 13 for gaining unwarranted entrance into the dwelling.

From FIG. 1 et al of the drawings it may be seen that the window guard means 11 of the present invention includes release means generally indicated at 27 for cooperating with the fusible link means 25 in supporting the movable portion 21 in the UP position thereof and for releasing the movable portion 21 when the fusible link means 25 becomes ineffective. In this manner the movable portion 21 is readily enabled to gravitate to the DOWN position thereof in providing the escape route for the inhabitants of the dwelling in the event of fire. The release means 27 will be more fully disclosed later in the specification.

From FIGS. 1, 5–7 of the drawings it may be seen that the window guard means 11 of the present invention includes way means, as at 29, for accommodating the slidable action of the movable portion 21 without negating the effectiveness of the anti-intrusion bar means 15. In this manner, travel of the movable portion 21 between the UP and DOWN positions thereof is readily facilitated.

The release means 27 alluded to above preferably includes a left hand portion, as at **27*a* in FIG. 1, and a right hand portion, as at 27*b* therein. The portions 27*a*, 27*b* are substantially identical one with the other, therefore, a detailed disclosure of merely the right hand portion 27*b* will be disclosed. However, it should be understood that the left hand portion 27*a* is substantially identical with the right hand portion 27*b*. However, it will be understood that the fusible link means 25 preferably interconnects the left hand portion 27*a* with the right hand portion 27*b* as clearly shown in FIG. 1** of the drawings.

Figure 6:
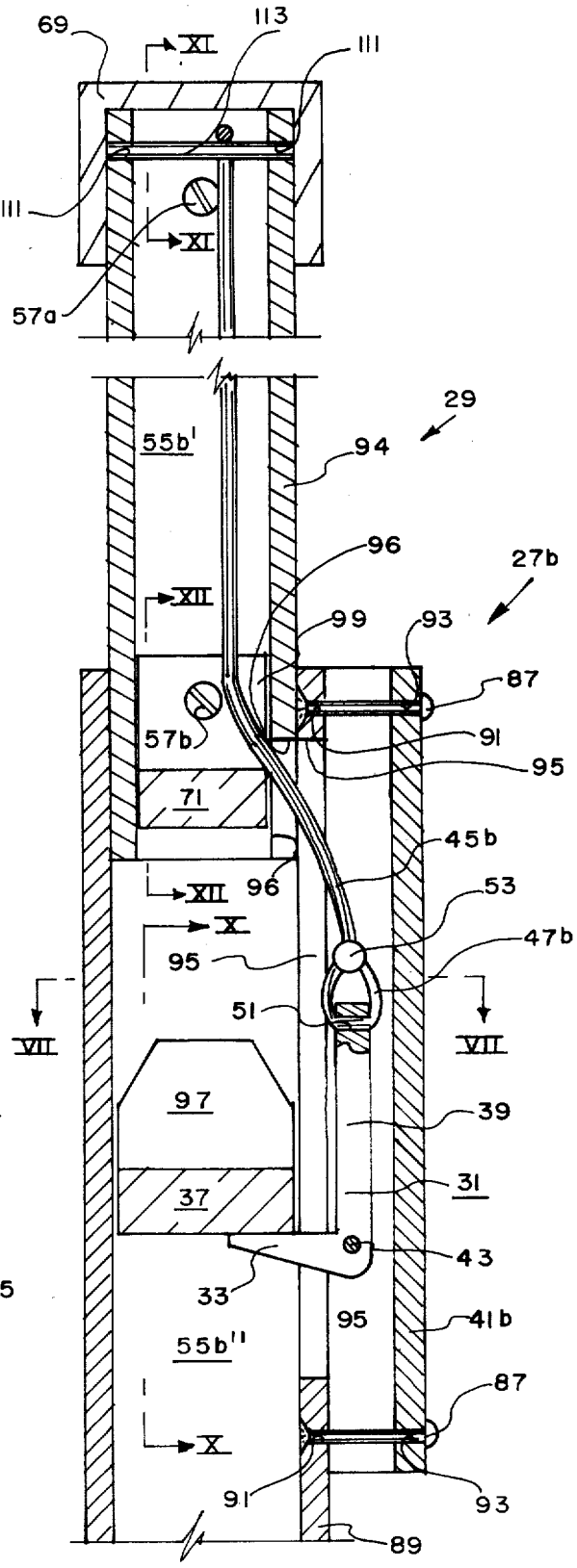
FIG. 6 is an enlarged partial sectional view taken as on the line VI—VI of FIG. 1.
Figure 8:
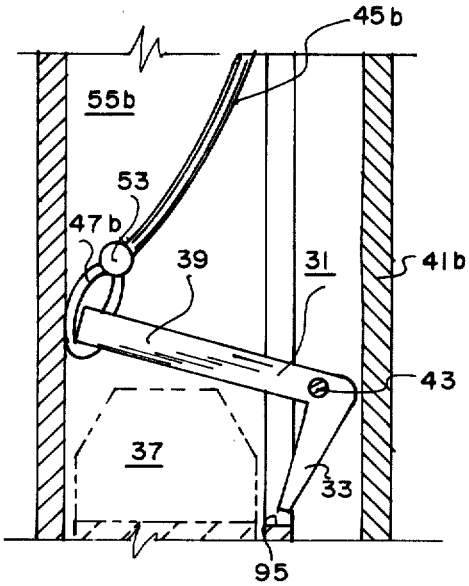
FIG. 8 is an enlarged partial sectional view taken as on the line VIII—VIII of FIG. 3.

The release means **27*b* includes pawllike means, as at 31 and as best view in FIGS. 6 and 8 of the drawings, for reasons about to be disclosed. The pawllike means 31 includes a normally horizontally disposed footlike member 33 for reaching beneath and restingly engaging a non-stationary main support member, as at 37 (i.e., being part and partial of the movable portion 21 of the anti-intrusion bar means 15) when the movable portion 21 is disposed in the UP position thereof. The pawllike means 31 also includes a leglike member, as at 39, which is disposed substantially perpendicular with the footlike member 33 for providing leverage action in maintaining the footlike member 33 in the normally horizontal disposition thereof or as shown in FIG. 6** of the drawings.

The release means **27*b* also includes a body member, as at 41, having the pawllike means 31 pivotally attached thereto (i.e., via a pivot member 43) for pivotal movement between a LATCHED position (as shown in FIG. 6) wherein the movable portion 21 may be adequately secured in the UP position thereof an an UNLATCHED position wherein the movable portion 21 may be released, thus enabling it to gravitate to the DOWN position 21'** thereof.

The release means **27*b* also includes latchstring means, as at 45, for operating the pawllike means 31. Moreover, one of the ends, as at 47, of the latchstring means 45 is fastened to the leglike member 39 whereby tension may be applied to the latchstring means 45 to urge the pawllike means 31 to assume the LATCHED positions thereof. The other end, as at 49, of the latchstring 45 is fastened to the fusible link means 25 whereby the pawllike means 31 is being held in the LATCHED position thereof until such time as the fusible link means 25 is rendered ineffective which action is effective in releasing the tension being applied to the latchstring means 45. In this manner the weight of the movable portion 21 is enabled to cause pivotal movement of the pawllike means 31 to the position as shown in FIG. 8 so as to release the movable portion 21 for travel to the DOWN position 21' as shown in FIG. 3** of the drawings.

The latchstring means 45 may be formed from various types of material, e.g., nylon string or the like, however, the preferred material for this structure is well-known flexible steel cable or the like. The end at 47 is suitably attached to the leg member 39 in any well-known manner, e.g., the leg member 39 is provided with an aperture, as at 51, having a suitable size for receiving the latchstring means 45 as best shown in FIG. 6 of the drawings. The end 47 preferably is doubled back and suitably attached as with any well-known fastening structure, such as clevis means as at 53, or the like.

Figure 5:
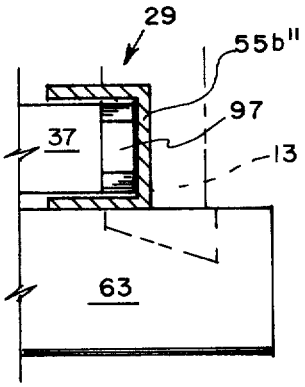
FIG. 5 is an enlarged partial sectional view taken as on the line V—V of FIG. 3.
Figure 7:
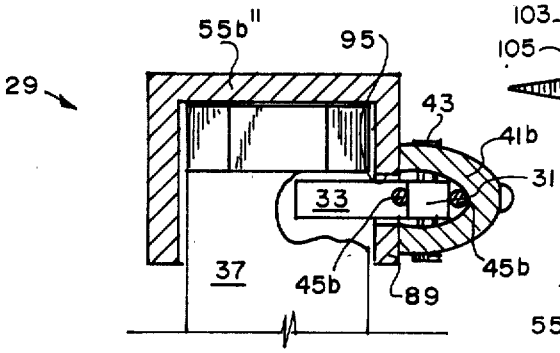
FIG. 7 is an enlarged partial sectional view taken as on the line VII—VII of FIG. 6.

The way means 29 alluded to above preferably includes a pair of inwardly directed channel members, as at **55*a*, 55*b* in FIGS. 1 and 3 of the drawings, or more specifically like the channel member 55*b*, as shown in FIG. 5 of the drawings. The length of the channel members 55*a*, 55*b* could, if desired, be sufficient to reach from the top of the window opening to the sill structure. However, in order to provide a degree of adjustability for variance in window sizes, applicant prefers that the channel members 55*a*, 55*b* not be continuous but rather divided as best shown in FIG. 6 of the drawings so as to constitute upper sections, as at 55*a'* and 55*b'* as well as lower sections, as at 55*a''* and 55*b''*, i.e., FIG. 6 depicts the upper and lower sections 55*b'* and 55*b''*** respectively.

Figure 4:
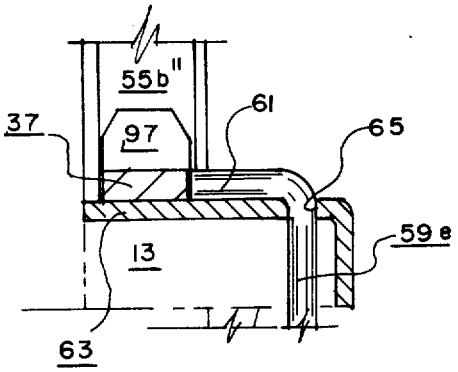
FIG. 4 is an enlarged partial sectional view taken as on the line IV—IV of FIG. 3.

Albiet, the channel members **55*a*, 55*b* preferably are fixedly attached to the usual window structure in any well-known manner as by a plurality of screws, as at 57*a*, 57*b*, 57*c*, etc., and as best shown in FIG. 1 of the drawings. Accordingly, the channel members 55*a* and 55*b* slidably receive the respective outermost ends of the previously mentioned non-stationary support member 37 (which, of course, is constituted by the movable portion 21 of the anti-intrusion bar means 15). From FIGS. 1 and 3 of the drawings it may also be seen that the anti-intrusion bar means 15 also includes a plurality of non-stationary vertically disposed spaced apart metal bar members, as at 59*a*, 59*b*, 59*c*, 59*d*, 59*e*, etc., for aiding in precluding unwarranted access into the dwelling. The upper ends of the bar members 59 are fixedly attached in any well-known manner, as by welding or the like, to the non-stationary main support member 37. However, it should be noted (particularly in FIGS. 2 and 4 of the drawings) that each of the bar members 59 preferably terminates upward thereof at a substantially 90° bent leg portion, as at 61, which, of course, is fixedy attached to the non-stationary main support member 37**.

The way means 29 also includes a window sill platelike member, as at 63, having either end thereof fixedly attached in any well-known manner, as by welding or the like, to the pair of channel members 55*a*, 55*b*. The window sill platelike member 63 is provided with a plurality of holes (like the one shown in FIG. 2 by the numeral 65) for respectively receiving the plurality of metal bar members 59. Accordingly, the metal bar members are free to slide through the holes 65 as the movable portion 21 is caused to move between the UP and DOWN positions thereof.

The anti-intrusion bar means 15 also includes a plurality of stationary vertically disposed spaced apart bar members, as at 67*a*, 67*b*, 67*c*, and 67*e*, etc., for aiding in precluding unwarranted access into the dwelling. The upper ends of the plurality of stationary metal bar members are fixedly attached, in any well-known manner as by welding or the like, to a stationary horizontal disposed metal channel members, as at 69. The lower ends of the stationary metal bar members are fixedly attached, as by welding or the like, to a stationary horizontally disposed rigid bar member, as at 71.

Each of the upper ends of the stationary bar members 67 preferably terminates at a 90° bent portion, like the bar member 67*e* as shown in FIG. 2 of the drawings by the bent portions 73. Of course, the bent portions 73 preferably are welded to the stationary channel members 69. From FIG. 6 of the drawings it may readilly be seen that the stationary channel member 69 straddles the upper ends of the vertical channel members 55*a*, 55*b*, thereby locking the stationary channel member 69 in place.

From FIGS. 1-3 of the drawings it may be seen that the anti-intrusion bar means 15 includes a plurality of metallic cruciform members, as at 75, for also aiding in precluding unwarranted access into the dwelling. The cruciform members 75 are fixedly attached, in any well-known manner as by welding or the like, to certain ones of the plurality of stationary vertically disposed spaced apart metal bar members 67. It should be understood, however, that the cruciform members 75 may be deleted from the device 11 without departing from the spirit and scope of the present invention.

The window guard means 11 also includes stop means, as generally indicated at 77 in FIGS. 1 and 3 of the drawings, which preferably includes a pair of stop members 77*a*, 77*b*. The stop members 77*a*, 77*b* are arranged for arresting engagement with the movable portion 21 to preclude upward travel thereof beyond its desirable limits of travel when disposed in the UP position thereof. More specifically, the non-stationary main support member 37 arrestingly engages the stop members 77*a*, 77*b* when disposed in the position shown in FIG. 1 of the drawings.

Each of the stop members 77*a*, 77*b* includes a planar main body portion 79 having a perpendicularly disposed tab portion 81 integrally joined therewith, i.e., the planar main body portion 79 is clearly shown in FIG. 2 of the drawings while the tab portion 81 may best be viewed in FIG. 1 of the drawings.

The stop members 77*a*, 77*b* are fixedly attached to the stationary rigid bar member 71 in any well-known manner as by bolt and nut structure respectively indicated at 83, 85 in FIGS. 1 and 2 of the drawings, i.e., the rigid bar member 71 and the tab portions 81 are suitably provided with aligned apertures (not shown) for receiving the bolt 83 in a typical fashion. Therefore, the stop members 77*a*, 77*b* preclude upward travel of the movable portion 21 beyond its desirable limits of travel when in the UP position, i.e., the support member 37 is shown in FIG. 2 as being in engagement with the body portion 79.

From FIG. 6 of the drawings it may clearly be seen that the body member 41*b* is fixedly attached to the channel member 55*b*'' via a pair of flathead rivets or the like, as at 87. More specifically, the channel member 55*b*'' includes a flange portion 89 which is suitably provided with a pair of countersunk bores, as at 91, and the body member 41 is provided with a pair of bores 93 for receiving the rivets 87.

Figure 10:
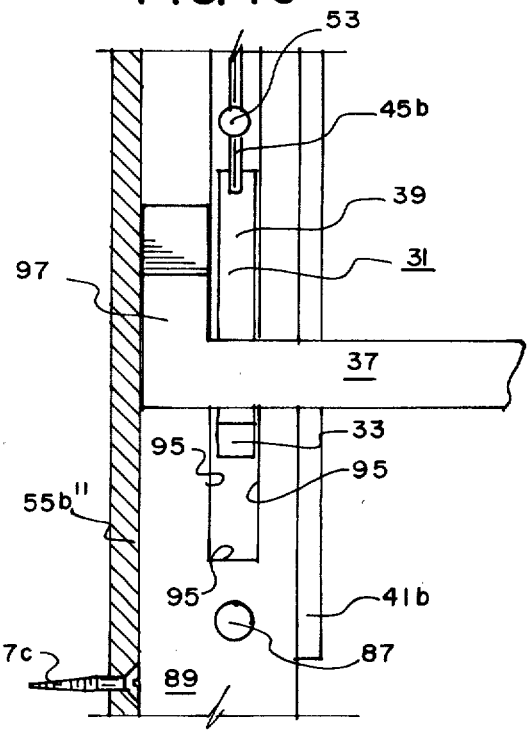
FIG. 10 is an enlarged partial sectional view taken as on the line X—X of FIG. 6, the view being extended downwardly to reveal particular screw fastener means.

The flange member 89 is also provided with an aperture, as at 95 and best viewed in FIG. 10, for accommodating the pawllike means 31.

Figure 12:
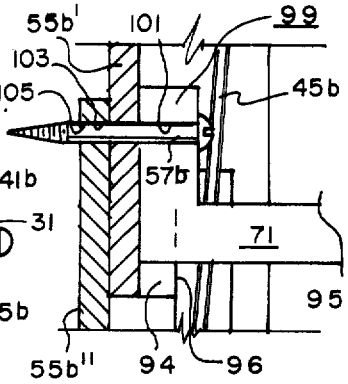
FIG. 12 is an enlarged partial sectional view taken as on the line XII—XII of FIG. 6.

The channel member 55*b*' includes a flange portion 94 which in certain size windows may necessitate being provided with either an opening or a notch, as at 96 in FIGS. 6 and 12, for also accomodating the pawllike means 31. However, perhaps merely the latchstring means will extend through the notch 96 in the manner best viewed in FIG. 6.

Figure 11:
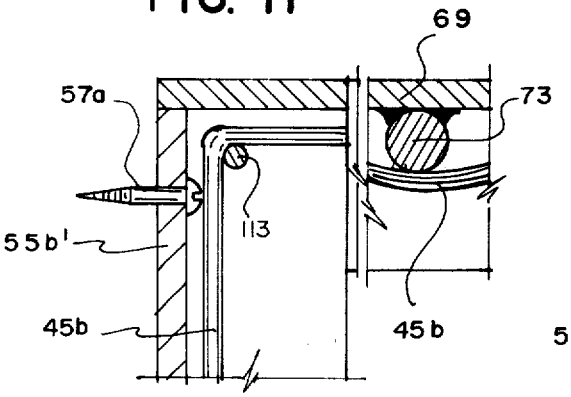
FIG. 11 is an enlarged partial sectional view taken as on the line XI—XI of FIG. 6.

It will be appreciated by those skilled in the art that the pair of screws 57*c* preferably are not roundheaded as shown for the screws 57*a* in FIG. 11 and 57*b* in FIG. 12 but rather are flatheaded and countersunk somewhat like that shown in FIG. 10. In this manner the heads of the screws 57*c* will not interfere with the traveling movement of the non-stationary main support member 37.

From FIGS. 6 and 10 of the drawings it may clearly be seen that the non-stationary main support member 37 terminates at either of the ends thereof at a turned up portion, as at 97.

Likewise, from FIGS. 6 and 12 of the drawings it may readily be seen that both ends of the statonary rigid bar member 71 terminate at turned up portions like that shown as at 99 in FIGS. 6, 12. Each portion 99 is provided with an aperture, as at 101 in FIG. 12, for receiving one of the screws 57*b*, i.e., of course, the channel members 55*b*' and 55*b*'' are provided with apertures, as at 103, 105, which may be aligned for receiving the screw 57*b*. In a similar fashion, the channel members 55*a*' and 55*a*'' are prepared for receiving the screw 57*b* appertaining thereto.

Particular attention is now directed toward FIG. 9 of the drawings wherein it may be seen that the stationary channel member 69 and the appropriate trim (shown in phantom lines) for the usual window 13 are provided with canted apertures 107 through which the latchstring means 45 may freely be received.

The upper ends of the channel members 55*a*' and 55*b*' are provided with apertures, as at 111 as shown in FIG. 6 of the drawings for merely the channel member 55*b*'. A pair of drift pins, as at 113, are recieved within the respective apertures 111 prior to the stationary channel member 69 being installed in the position shown in FIG. 6. Therefore, the drift pins 113 are captured in the apertures 111. The purpose for the drift pins 113 is to simply act somewhat as sheaves in properly guiding the respective latchstring means 45*a*, 45*b* as they are routed from a vertical position to a horizontal position or as best shown in FIG. 1 of the drawings.

From FIG. 2 of the drawings it may be seen that the window sill platelike member 63 includes a down turned skirt portion, as at 115, which simply drapes over the terminal ends of the non-stationary bar members 59 when the movable portion 21 is in the UP position.

The window guard means 11 is operated by first manually lifting the movable portion 21 to the position shown in FIG. 1 and while being held in place the latchstring means 45*a*, 45*b* are properly guided in the manner above described so as to ultimately pass outwardly through the apertures 107, at which time the fusible link means 25 is suitably attached to the terminal ends 49*a*, 49*b* of the respective latchstring means 45*a*, 45*b*. Of course, the tensions placed on the latchstring means 45*a*, 45*b* are effective in moving the pawllike means 31 from the position shown in FIG. 8 of the drawings to that shown in FIG. 6 of the drawings so that the footlike member 33 restingly supports the non-stationary support member 37 as clearly shown in FIG. 6 of the drawings.

In the event of fire the fusible link means 25 is rendered ineffective and falls away which enables the movable portion 21 to gravitate to that position 21' shown in FIG. 3 of the drawings. In addition, the terminus ends 49*a*, 49*b* are caused to pass through the apertures 107 and dangle freely as shown in FIG. 3 of the drawings. Of course, the weight of the movable portion 21 is sufficient to urge rotation of the pawllike means 31 from the position shown in FIG. 5 of the drawings to that as shown in FIG. 8 of the drawings. This allows the non-stationary main support member 37 to pass on downwardly as suggested in FIG. 8 of the drawings and to utilmately come to rest when it engages the window sill platelike member 63 as clearly shown in FIG. 3 of the drawings. Thereby, the fire escape route is automatically provided via the portion 23 in FIG. 3 while denying the intruder the convenience of utilizing the usual window structure for gaining unwarranted entrance into the building.

Although the invention has been described and illustrated with respect to a preferred embodiment thereof, it is to be understood that it is not intended to be so limited since changes and modifications may be made therein which are within the full intended scope of the invention.

I claim:

1. Window guard means for providing a degree of security against an intruder gaining entrance into a dwelling through the usual window structure of the type including a window frame having a generally horizontal top frame structure and generally vertical first and second side frame structures coupled to opposite ends of said top frame structure, said window guard means comprising:

(a) anti-intrusion bar means disposed on the interior side of said window structure and in proximity thereto, said anti-intrusion bar means including a movable portion for being situated for vertical slidable movement between a normally UP position in which at least a comparable portion of said window structure is adequately guarded therewith and a DOWN position in which an escape route through said window structure is provided the inhabitants of the dwelling in the event of fire, said movable portion including a support member having a first end and a second end; and (b) support means for normally supporting said movable portion of said anti-intrusion bar means in said UP position, said support means including a fusible link means for being attached to said top frame structure of said window frame substantially intermediate said first and second side frame structures, including a first latchstring member having a first end for being attached to said fusible link means and having a second end, including a first latch member attached to said second end of said first latchstring member for normally engaging said first end of said support member of said movable portion of said anti-intrusion bar means, said first latchstring member extending from said fusible link means along said top frame structure and down said first side frame structure, including a second latchstring member having a first end for being attached to said fusible link means and having a second end, and including a second latch member attached to said second end of said second latchstring member for normally engaging said second end of said support member of said movable portion of said anti-intrusion bar means, said second latchstring member extending from said fusible link means along said top frame structure and down said second side frame structure, said fusible link means releasing said latchstring members when exposed to a predetermined degree of heat, thus enabling gravitational movement of said movable portion of said anti-intrusion bar means from said UP position thereof to said DOWN position thereof in the event a fire breaks out within the dwelling, thereby, the fire escape route being automatically provided while denying the intruder the convenience of utilizing said window structure for gaining unwarranted entrance into the dwelling.

2. The window guard means as set forth in claim 1 in which is included way means for accommodating the slidable action of the movable portion of said anti-intrusion bar means without negating the effectiveness of said anti-intrusion bar means, thus facilitating travel of the movable portion of said anti-intrusion bar means between said UP and DOWN positions thereof.

3. The window guard as set forth in claim 2 in which said way means includes a pair of inwardly directed confrontingly arranged channel members fixedly attached to said window structure for slidably receiving said first and second ends of said support member of said movable portion of said anti-intrusion bar means which additionally includes a plurality of non-stationary vertically disposed spaced-apart metal bar members for aiding in precluding unwarranted access into the dwelling and having the upper ends thereof fixedly attached to said non-stationary main support member, said way means also includes a window sill platelike member having either end thereof fixedly attached to said pair of channel members and having a plurality of holes provided therein for respectively receiving said plurality of metal bar members which are free to slide through said holes as the movable portion of said anti-intrusion bar means is caused to move between said UP and DOWN positions thereof.

4. The window guard means as set forth in claim 1 in which each of said first and second latch members includes pawllike means having a normally horizontally disposed footlike member for reaching beneath and restingly engaging a respective one of said first and second ends of said support member of said movable portion of said anti-intrusion bar means when the latter is disposed in said UP position thereof; a leglike member disposed substantially perpendicular with said footlike member for providing leverage action in maintaining said footlike member in the normally horizontal disposition thereof; and a pivot member for pivotally attaching said pawllike means to a respective one of said first and second side frame members of said frame of said window structure to allow pivotal movement of said pawllike means between a LATCHED position wherein said movable portion of said anti-intrusion bar means may be adequately secured in said UP position thereof and an unlatched position wherein said movable portion may be released, thus enabling it to gravitate to the DOWN position thereof; said first and second latchstring members being fastened to said leglike member of said first or second latch member respectively whereby tension may be applied to said latchstring members to urge said pawllike means to assume said LATCHED position thereof, whereby each of said pawllike means is being held in said LATCHED position thereof until such time as said fusible link means releases said latchstring members which action is effective in releasing the tension being applied to said latchstring members, thus enabling the weight of said movable portion of said anti-intrusion bar means to cause pivotal movement of each of said pawllike means so as to release said movable portion of said anti-intrusion bar means for travel to the DOWN position thereof.

5. The window guard means as set forth in claim 1 in which said anti-intrusion bar means includes a plurality of stationary vertically disposed spaced apart metal bar members for aiding in precluding unwarranted access into the dwelling and having the upper ends thereof fixedly attached to a stationary horizontally disposed metal channel member and the lower ends thereof fixedly attached to a stationary horizontally disposed rigid bar member, and a plurality of metallic cruciform members for also aiding in precluding unwarranted access into the dwelling and being fixedly attached to certain ones of said plurality of stationary vertically disposed spaced apart metal bar members.

6. The window guard means as set forth in claim 1 in which is included stop means arranged for arresting engagement with said movable portion of said anti-intrusion bar means to preclude upward travel thereof beyond its desirable limits of travel when disposed in said UP position thereof.

7. The window guard means as set forth in claim 6 in which said anti-intrusion bar means includes a plurality of stationary vertically disposed spaced apart metal bar members for aiding in precluding unwarranted access into the dwelling and having the upper ends thereof fixedly attached to a stationary horizontally disposed metal channel member and the lower ends thereof fixedly attached to a stationary horizontally disposed rigid bar member, and in which said stop means includes a pair of stop members disposed adjacent either end of said rigid bar member and being fixedly attached thereto, thus precluding upward travel of the movable portion of said anti-intrusion bar means beyond its desirable limits of travel when in said UP position thereof.

* * * * *